US006601849B1

(12) United States Patent
Konkle et al.

(10) Patent No.: US 6,601,849 B1
(45) Date of Patent: Aug. 5, 2003

(54) GOLF BALL SPHERICAL PUZZLE

(76) Inventors: Mark A. Konkle, 4280 Sunderland Way, Ann Arbor, MI (US) 48103; Carl Reid, 8097 Hillside Lakes, Brighton, MI (US) 48116; Kenneth P. Bandy, 6915 Heather Ridge Dr., Saline, MI (US) 48176

( * ) Notice: Subject to any disclaimer, the term of this patent is extended or adjusted under 35 U.S.C. 154(b) by 0 days.

(21) Appl. No.: 09/697,695

(22) Filed: Oct. 26, 2000

Related U.S. Application Data

(60) Provisional application No. 60/161,635, filed on Oct. 27, 1999.

(51) Int. Cl.[7] ..... A63F 9/12
(52) U.S. Cl. ..... 273/157 R; 273/156
(58) Field of Search ..... 273/160, 157 R, 273/156; D21/479

(56) References Cited

U.S. PATENT DOCUMENTS 245,533 A * 8/1881 McChesney ..... 273/160
2,201,724 A * 5/1940 Gable ..... 273/157 R
D138,214 S * 7/1944 Miller ..... 273/157 R
5,230,508 A * 7/1993 Tabler ..... 273/157 R
5,826,873 A * 10/1998 Lavermicocca ..... 273/157 R
6,095,521 A * 8/2000 Patel ..... 273/160

* cited by examiner

*Primary Examiner*—Steven Wong
(74) *Attorney, Agent, or Firm*—Brinks Hofer Gilson & Lione

(57) ABSTRACT

A multiple piece puzzle comprises a solid sphere with the external appearance of a golf ball of modern construction. A series of curving cuts through the sphere separate the sphere into a plurality of separate pieces wherein the cuts form complementary pairs of surfaces among the separate pieces. Proper assembly of the pieces solves the puzzle and restores the golf ball appearance of the puzzle. The curving cuts form interlocks between the pairs of complementary surfaces whereby, once assembled, the sphere will be retained together in three dimensions in a similar manner as two-dimensional puzzle pieces are retained together. In the preferred embodiment, the puzzle comprises eight pieces that can slide together, however, the puzzle can be formed with more pieces for added complexity and more challenge.

10 Claims, 1 Drawing Sheet

GOLF BALL SPHERICAL PUZZLE

This complete application claims the benefit of provisional patent application No. 60/161,635, filed Oct. 27, 1999.

BACKGROUND OF THE INVENTION

The field of the invention pertains to three-dimensional puzzles and, in particular, to spherical puzzles having interlocking parts.

An early example of a solid spherical puzzle is disclosed in U.S. Pat. No. 766,444 wherein a plurality of prismatic pieces form the puzzle. U.S. Pat. No. 1,546,024 also discloses prismatic pieces that interlock to form the solid sphere of the puzzle. A plurality of planar pieces interlock to form a solid spherical puzzle in U.S. Pat. No. 2,034,830. In U.S. Pat. No. 4,889,340 and U.S. Pat. No. 5,452,895, the exterior pieces move on tracks or rails about a substantially solid core. Likewise, in U.S. Pat. No. 4,377,286, U.S. Pat. No. 4,378,117 and international application PCT/AT81/00010, the exterior pieces move on interior mechanisms.

Hollow spherical puzzles are also known. U.S. Pat. No. 4,441,715 illustrates a hollow spherical puzzle wherein the pieces comprise sectors truncated by the hollow interior. In U.S. Pat. No. 4,522,401 and U.S. Pat. No. 5,114,148, the exterior pieces move on tracks about a hollow or solid core. Most of the above patents disclose geometrically and mechanically complicated mechanisms to guide the puzzle pieces. Moreover, in most of these patents the pieces always remain interconnected and are not disconnected in operating the puzzle.

Puzzles where the pieces are purposely separable are shown in U.S. Pat. No. 766,444 and U.S. Pat. No. 1,546,024 where the solid puzzles comprise prismatic pieces. Hollow puzzles where the pieces are all separable are shown in U.S. Pat. No. 3,578,331. These pieces snap or dovetail together to form the hollow puzzle.

SUMMARY OF THE INVENTION

The new puzzle comprises a solid sphere with the external appearance of a golf ball of modern construction. A series of curving cuts through the sphere separate the sphere into a plurality of separate pieces wherein the cuts form complementary pairs of surfaces among the separate pieces. Proper assembly of the pieces solves the puzzle and restores the golf ball appearance of the puzzle. The curving cuts form interlocks between the pairs of complementary surfaces whereby, once assembled, the sphere will be retained together in three dimensions in a similar manner as two-dimensional puzzle pieces are retained together. The curving cuts at the surface of the puzzle sphere resemble two-dimensional puzzle cuts in the preferred embodiment and permit the puzzle to be very economically manufactured with simple curvatures. In the preferred embodiment, the puzzle comprises eight pieces that can be slid together; however, the puzzle can be formed with more pieces for added complexity and more challenge to slide the pieces together in the proper order.

DESCRIPTION OF THE PREFERRED EMBODIMENT

Figure 1:
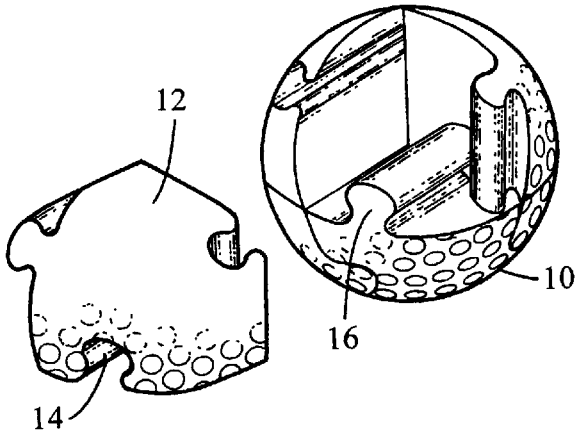
FIG. 1 is a perspective view of the new spherical puzzle with one piece removed.
Figure 2:
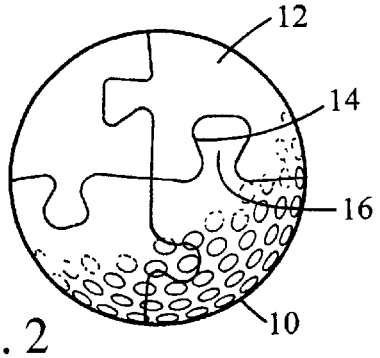
FIG. 2 is a front view of the completed puzzle.

As shown in FIG. 1, the puzzle has the exterior appearance 10 of a golf ball typically covered with dimples; however, any other appealing exterior surface may be substituted. The interior is completely filled with no purposely hollow volumes as shown by piece 12 separated from the other pieces of the spherical puzzle. The puzzle in this embodiment comprises eight pieces, each piece having only one surface forming a portion of a surface of a sphere, that interlock together with complementary undercut channels 14 and studs 16 forming surfaces adapted to slide together and apart in a three-dimensional analogy to a planar puzzle. Thus, the channels 14 and studs 16 contain surface elements that are formed of straight line elements. Accordingly, the channels 14 form female portions and the studs 16 form male portions of an interlock that prevents lateral separation of two of the pieces when the two pieces are engaged together.

Figure 3:
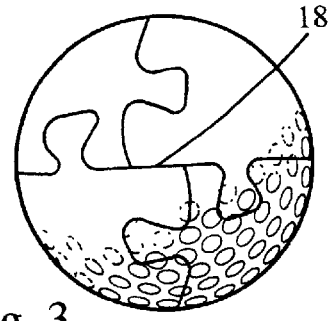
FIG. 3 is a back view of the completed puzzle.
Figure 4:
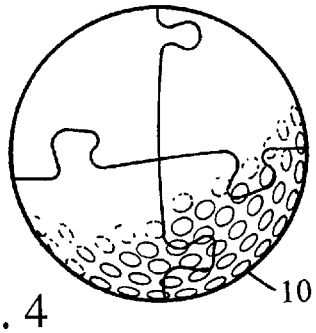
FIG. 4 is a top view of the completed puzzle.
Figure 5:
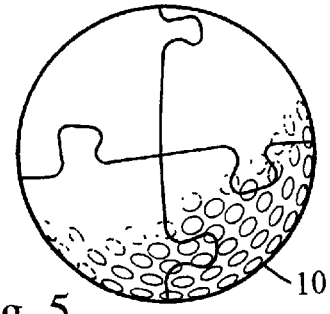
FIG. 5 is a bottom view of the completed puzzle.
Figure 6:
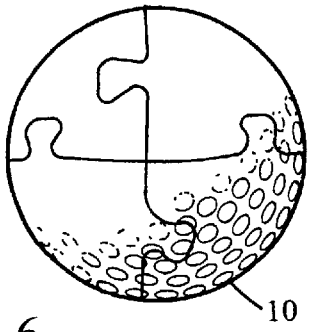
FIG. 6 is a right view of the completed puzzle.
Figure 7:
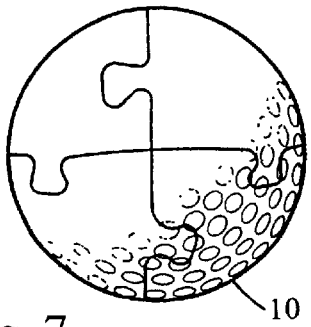
FIG. 7 is a left view of the completed puzzle.

Since no two pieces are identical, the puzzle can only be assembled by sliding the pieces together in the proper order. Where the puzzles are hand made by cutting a solid sphere with a jeweler's saw blade, for example, no two puzzles will be identical, thus leading to more challenge. As shown at 18 in FIG. 3, the pieces need not all come together at one diametrical line but may be "shifted" to add interest.

The puzzles may be constructed of any suitable solid material, such as wood, metal or plastics. As shown, the puzzle is formed by cutting a solid core golf ball with a jeweler's blade. Three cuts are made to first cut the ball in half, then a second cut into quarters and then a third cut to form the eight pieces.

For mass production the individual pieces may be molded separately with each piece unique relative to the other seven of each complete puzzle. Molding is most suitable for plastic materials. Die casting is suitable for many metals. A numerically controlled saw is suitable for mass production of wooden puzzles. Using modern laser cutting or electro-discharge machining, the puzzles may even be produced from solid, relatively hard, metals and ceramics.

What is claimed is:

1. A puzzle comprising:

an even number of separable non-identical pieces each having only one exterior surface forming a portion of the surface of a sphere and other surfaces each complementary to a surface on another piece of the puzzle, the complementary surfaces each including at least one curving surface cut resembling the curving undercut of a two-dimensional puzzle, and formed of straight line elements defining an interlock means for preventing lateral separation of two of the pieces when engaged together, the straight line elements of each curving surface of the complementary surfaces being generally perpendicular to the straight line elements of each of the other complementary surfaces, the plurality of separable pieces, upon engagement of all of the complementary surfaces, forming a sphere and interlocking so as to maintain engagement in the form of the sphere.

2. The puzzle of claim 1 wherein said plurality of pieces upon engagement of all of the complementary surfaces, forms a solid sphere.

3. The puzzle of claim 1 wherein said complementary surfaces slide together in directions generally along said straight line elements.

4. The puzzle of claim 1 wherein said puzzle comprises eight pieces.

5. The puzzle of claim 4 wherein said eight pieces assembled together form a solid sphere.

6. The puzzle comprising:

an even number of separable non-identical pieces each having only one surface forming a portion of the exterior surface of the assembled puzzle and three other surfaces each complimentary to a surface on another piece of the puzzle, the complimentary surfaces each including at least one curving surface cut resembling the curving undercut of a two-dimensional puzzle and formed of generally straight line elements defining an interlock means for preventing lateral separation of two of the pieces when engaged together, said straight line elements of each curving surface of said complementary surfaces being perpendicular to the straight line elements of each of the other complementary surfaces, the pieces, upon engagement of all of the complementary surfaces, forming the complete solved puzzle and interlocking so as to be retained together in an assembled state.

7. The puzzle of claim 1 wherein the pieces each include at least one male interlock means and at least one female interlock means.

8. The puzzle of claim 1 wherein at least some of the pieces include two male interlock means and other of the pieces include two female interlock means.

9. The puzzle of claim 6 wherein the pieces each include at least one male interlock means and at least one female interlock means.

10. The puzzle of claim 6 wherein at least some of the pieces include two male interlock means and other of the pieces include two female interlock means.

* * * * *

UNITED STATES PATENT AND TRADEMARK OFFICE

CERTIFICATE OF CORRECTION

PATENT NO. : 6,601,849 B1
DATED : August 5, 2003
INVENTOR(S) : Mark A. Konkle et al.

It is certified that error appears in the above-identified patent and that said Letters Patent is hereby corrected as shown below:

Title page,
Item [76], Inventors, delete "8097 Hillside Lakes," and substitute
-- 4381 Summer Hill, -- in its place.

Signed and Sealed this

Twenty-seventh Day of January, 2004

JON W. DUDAS
*Acting Director of the United States Patent and Trademark Office*